US011821264B2

(12) United States Patent
Takeuchi et al.

(10) Patent No.: US 11,821,264 B2
(45) Date of Patent: Nov. 21, 2023

(54) DRILLING TIP AND DRILL BIT

(71) Applicant: MITSUBISHI MATERIALS CORPORATION, Tokyo (JP)

(72) Inventors: Yuichiro Takeuchi, Naka (JP); Toshihiko Matsuo, Naka (JP); Wardoyo Akhmadi Eko, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 415 days.

(21) Appl. No.: 17/279,320

(22) PCT Filed: Sep. 27, 2019

(86) PCT No.: PCT/JP2019/038218
§ 371 (c)(1),
(2) Date: Mar. 24, 2021

(87) PCT Pub. No.: WO2020/067450
PCT Pub. Date: Apr. 2, 2020

(65) Prior Publication Data

US 2022/0349261 A1 Nov. 3, 2022

(30) Foreign Application Priority Data

Sep. 28, 2018 (JP) ..... 2018-184791
Sep. 26, 2019 (JP) ..... 2019-175936

(51) Int. Cl.
*E21B 10/573* (2006.01)
*E21B 10/567* (2006.01)

(52) U.S. Cl.
CPC ..... *E21B 10/573* (2013.01); *E21B 10/567* (2013.01); *E21B 10/5673* (2013.01)

(58) Field of Classification Search
CPC ... E21B 10/573; E21B 10/567; E21B 10/5673
See application file for complete search history.

(56) References Cited

U.S. PATENT DOCUMENTS 4,109,737 A 8/1978 Bovenkerk
4,776,413 A 10/1988 Forsberg
(Continued)

FOREIGN PATENT DOCUMENTS

GB 2367081 A 3/2002
JP 60-058357 B 12/1985
(Continued)

OTHER PUBLICATIONS

International Search Report dated Nov. 26, 2019 for the corresponding PCT International Patent Application No. PCT/JP2019/038218.
(Continued)

*Primary Examiner* — Brad Harcourt
(74) *Attorney, Agent, or Firm* — Leason Ellis LLP; Melvin C. Garner; Mitsuhiro Haraguchi

(57) ABSTRACT

A drilling tip includes a tip main body that has a posterior end portion having a columnar or disk shape centered on a tip center line and a distal end portion and is made of a cemented carbide and a hard layer that coats the distal end portion and is made of a polycrystalline diamond sintered body. The distal end portion has a convex portion, and a concave portion. A diameter D of the posterior end portion is 8 mm to 20 mm. A ratio r1/D of a radius r1 of the convex portion is 0.1 to 0.65, and a ratio r2/D of a radius r2 of the concave portion is 0.05 to 3.0. An angle formed by a straight line that connects a tangent point which the convex portion tangents to the concave portion and a center of the convex portion to each other is 20° to 90°.

6 Claims, 6 Drawing Sheets

(56) References Cited

U.S. PATENT DOCUMENTS

| | | | | |
|---|---|---|---|---|
| 5,379,854 | A | 1/1995 | Dennis | |
| 6,315,065 | B1 | 11/2001 | Yong et al. | |
| 6,484,826 | B1 | 11/2002 | Anderson et al. | |
| 8,857,541 | B2 | 10/2014 | Mourik et al. | |
| 10,480,252 | B2 * | 11/2019 | Belnap | E21B 10/567 |
| 2001/0008190 | A1 | 7/2001 | Scott et al. | |
| 2001/0040053 | A1 * | 11/2001 | Beuershausen | E21B 10/5673 175/57 |
| 2002/0007972 | A1 | 1/2002 | Yong et al. | |
| 2004/0112650 | A1 * | 6/2004 | Moseley | E21B 10/5673 175/426 |
| 2011/0031032 | A1 * | 2/2011 | Mourik | C22C 26/00 175/428 |

FOREIGN PATENT DOCUMENTS

| | | | |
|---|---|---|---|
| JP | 62078394 | A | 4/1987 |
| JP | 63091583 | U | 6/1988 |
| JP | 03503793 | A | 8/1991 |
| JP | 2003515020 | A | 4/2003 |
| JP | 2016-135983 | A | 7/2016 |
| WO | 9001107 | A1 | 2/1990 |
| WO | 9612086 | A1 | 4/1996 |
| WO | 0138683 | A2 | 5/2001 |

OTHER PUBLICATIONS

Japanese Office Action dated Dec. 20, 2022 for the corresponding Japanese Patent Application No. 2019-175936 (7 pages including English translation).

European Search Report dated May 11, 2022 for the corresponding European Patent Application No. 19865104.4 ( 6 pages ).

* cited by examiner

DRILLING TIP AND DRILL BIT

CROSS-REFERENCE TO RELATED PATENT APPLICATIONS

This application is a U.S. National Phase Application under 35 U.S.C. § 371 of International Patent Application No. PCT/JP2019/038218 filed on Sep. 27, 2019 and claims the benefit of priority to Japanese Patent Applications No. 2018-184791, filed Sep. 28, 2018, and No. 2019-175936, filed Sep. 26, 2019, all of which are incorporated herein by reference in their entirety. The International Application was published in Japanese on Apr. 2, 2020 as International Publication No. WO/2020/067450 under PCT Article 21(2).

FIELD OF THE INVENTION

The present invention relates to a drilling tip, in which a distal end portion of a tip main body made of a cemented carbide is coated with a hard layer made of a polycrystalline diamond sintered body and which is attached to a distal end portion of a bit main body of a drill bit to perform drilling, and the drill bit in which such a drilling tip is attached to the distal end portion of the bit main body.

BACKGROUND OF THE INVENTION

Although such a drilling tip, in which a distal end portion of a tip main body made of a cemented carbide is coated with a hard layer made of a polycrystalline diamond sintered body, is manufactured by integrally sintering the cemented carbide of the tip main body and the polycrystalline diamond sintered body of the hard layer, due to a difference in a thermal expansion coefficient between the cemented carbide and the polycrystalline diamond sintered body, residual stress occurs near an interface therebetween when sintering. In a case where this residual stress is high, the drilling tip attached to a drill bit used in striking excavation has problems in which cracks are generated in the hard layer due to impact during drilling and the life of the drill bit is shortened.

Therefore, techniques, in which the residual stress of a hard layer made of such a polycrystalline diamond sintered body after sintering is relaxed, are described in U.S. Pat. Nos. 6,315,065, 8,857,541 and Japanese Unexamined Patent Application, First Application, No. 2016-135983. Among these, a technique, in which an intermediate layer having an inclined composition is interposed between an outermost layer of the hard layer and a tip main body, is described in U.S. Pat. No. 6,315,065. In addition, a technique, in which residual stress is relaxed by defining an intermediate layer thickness of the type of a material according to a purpose in view of a difference in a thermal expansion coefficient of a polycrystalline diamond sintered body, is described in U.S. Pat. No. 8,857,541. Further, a technique, in which the life of a drilling tip is extended as the thickness of the hard layer is secured so that a tip main body is not exposed even after an outer peripheral polishing step required when attaching the drilling tip to a drill bit, by controlling the shape of the tip main body, is described in Japanese Unexamined Patent Application, First Application, No. 2016-135983.

CITATION LIST

Patent Literature

[Patent Document 1]
U.S. Pat. No. 6,315,065
[Patent Document 2]
U.S. Pat. No. 8,857,541
[Patent Document 3]
Japanese Unexamined Patent Application, First Application, No. 2016-135983

Technical Problem

However, as described in U.S. Pat. Nos. 6,315,065 and 8,857,541, in the intermediate layer interposed between the outermost layer of the hard layer and the tip main body, the thickness of the outermost layer which is hardest in the hard layer cannot be secured even if residual stress is relaxed. In a case of being used in drilling the ground made of hard rock, the progress of wear of the hard layer is faster, and the tip main body made of a cemented carbide is likely to be exposed at an early stage, thereby shortening the life of the drill bit.

In addition, in the drilling tip described in Japanese Unexamined Patent Application, First Application, No. 2016-135983, the thickness is secured as described above on a posterior end side of the hard layer by forming a columnar or disk-shaped intermediate portion having an outer diameter smaller than a posterior end portion between the posterior end portion and a distal end portion of the tip main body. However, in this case, since an angled corner part is formed between a distal end surface of the posterior end portion of the tip main body and an outer peripheral surface of the intermediate portion, there is a tendency in which stress is likely to be concentrated on this corner part.

Herein, in the drilling tip described in Japanese Unexamined Patent Application, First Application, No. 2016-135983, the outer diameter of the intermediate portion further decreases in a case where the hard layer is made thicker in order to further extend the life. Thus, when an excessive load is present during drilling, with the corner part where stress is likely to be concentrated as a origin, cracks are likely to be generated in an interface of the intermediate portion between the tip main body made of a cemented carbide and the hard layer made of a polycrystalline diamond sintered body on the outer periphery. Due to the destruction of the hard layer caused by the cracks, there is a possibility that the life of the drill bit is shortened.

The present invention is devised under such circumstances, and an object thereof is to provide a long-life drilling tip, in which a distal end portion of a tip main body made of a cemented carbide is coated with a hard layer made of a polycrystalline diamond sintered body, the drilling tip allowing the prevention of generation of cracks in the hard layer by relaxing the residual stress of an interface between the tip main body and the hard layer, and improvement of impact resistance and wear resistance, and to provide a drill bit, to which such a drilling tip is attached and which has long life and can perform efficient drilling.

SUMMARY OF THE INVENTION

Solution to Problem

According to an aspect of the present invention, in order to solve the problems and achieve such an object, there is provided a drilling tip that is attached to a distal end portion of a drill bit to perform drilling. The drilling tip includes a tip main body that has a posterior end portion having a columnar or disk shape centered on a tip center line and a distal end portion having an outer diameter from the tip center line, which gradually decreases from the posterior end portion toward a distal end side, and is made of a cemented carbide and a hard layer that coats the distal end portion of the tip main body and is made of a polycrystalline diamond sintered body. The distal end portion of the tip main body has a convex portion having a convex arc shape of which a surface is convex toward the distal end side in a cross section taken along the tip center line, and a concave portion having a concave arc shape in a cross section taken along the tip center line, of which a surface tangents to a convex arc in the cross section of the convex portion and which extends to an outer peripheral side as going toward a posterior end side of the tip main body. A diameter D (mm) of the posterior end portion of the tip main body is within a range of 8 (mm) to 20 (mm). With respect to the diameter D (mm) of the posterior end portion of the tip main body, a ratio r1/D of a radius r1 (mm) of the convex arc of the convex portion in the cross section is within a range of 0.1 to 0.65, and a ratio r2/D of a radius r2 (mm) of a concave arc of the concave portion in the cross section is within a range of 0.05 to 3.0. An angle θ(°) formed by a straight line that connects a point which the convex portion tangents to the concave portion and a center of the convex arc of the convex portion to each other with respect to the tip center line in the cross section is within a range of 20(°) to 90(°).

In addition, according to another aspect of the present invention, there is provided a drill bit including such a drilling tip that is attached to a distal end portion of a bit main body. A fitting hole is formed in the distal end portion of the bit main body. The drilling tip is attached such that the posterior end portion of the tip main body is buried in the fitting hole.

In the drilling tip having the configuration, the distal end portion of the tip main body has the convex portion having the convex arc shape of which the surface is convex toward the distal end side in the cross section taken along the tip center line and the concave portion having the concave arc shape in the cross section taken along the tip center line, of which the surface tangents to the convex arc in the cross section of the convex portion and which extends to the outer peripheral side toward the posterior end side of the tip main body. Since corner parts intersecting with an angle are not formed, residual stress generated by sintering can be relaxed, and such corner parts do not serve as origins of cracks in the hard layer.

Herein, if the diameter D (mm) of the posterior end portion of the tip main body is smaller than 8 (mm), the residual stress of an interface between the hard layer and the tip main body can be relaxed, but an impact load acting on the tip main body per unit area increases in a case of being used in drilling under a higher impact load condition. Therefore, damage caused by the fracture origin in the tip main body is likely to occur, and there is a possibility that the life of the drill bit is shortened. On the other hand, when the diameter D (mm) of the posterior end portion of the tip main body is larger than 20 (mm), the volume of the hard layer is large with respect to the area of the tip main body in contact with the hard layer, residual stress that occurs at the interface between the hard layer and the tip main body cannot be relaxed, and thus there is a possibility that cracks are generated after sintering.

With respect to the diameter D (mm) of the posterior end portion of the tip main body which is within a range of 8 (mm) to 20 (mm), the ratio r1/D of the radius r1 (mm) of the convex arc of the convex portion in the cross section is within a range of 0.1 to 0.65, and the ratio r2/D of the radius r2 (mm) of the concave arc of the concave portion in the cross section is within a range of 0.05 to 3.0. The angle θ(°) formed by the straight line that connects the point which the convex portion tangents to the concave portion and the center of the convex arc of the convex portion to each other with respect to the tip center line in the cross section is within a range of 20(°) to 90(°). Therefore, the residual stress of the interface between the hard layer and the tip main body can be more reliably relaxed, and it is possible to extend the life by securing a sufficient thickness for the hard layer. The cross section taken along the tip center line may be a cross section taken along the tip center line in a range where a distance from the tip center line is 0.1 (mm) or less.

The hard layer is not particularly limited, but Vickers hardness of 4,000 HV or more and a thickness of 1.1 mm or more and 3.0 mm or less are preferable. Herein, the hard layer means a polycrystalline diamond sintered body portion, and in a case where a polycrystalline diamond sintered body layer is configured by two or more layers having different compositions, a layer positioned at an outermost periphery is the hard layer. In addition, the Vickers hardness of the hard layer is not limited to an upper limit, but the value of what can be industrially manufactured is 8,000 HV or less.

The Vickers hardness was measured at ten points under a load of 5 kg, and the average value is set as the Vickers hardness of the hard layer. The thickness of the hard layer is defined as a value obtained by acquiring an observation image along the tip center line C with the use of an optical microscope in a tip cross section which is cut along the tip center line and measuring.

That is, when the ratio r1/D is less than 0.1, the radius of the convex portion is excessively small compared to the thickness of the hard layer, and the curvature of the convex portion is large. Thus, residual stress is likely to be concentrated particularly at a distal end portion of the convex portion, and there is a possibility that cracks are likely to be generated in the hard layer. On the other hand, conversely, when the ratio r1/D exceeds 0.65, the thickness of the hard layer is small at an outer peripheral portion of the convex portion. The wear of the outer peripheral portion of the convex portion during drilling progresses early compared to the distal end portion so that the convex portion of the tip main body made of a cemented carbide is likely to be exposed. Thus, there is a possibility that the life of the drill bit is shortened.

In addition, when the ratio r2/D is less than 0.05, the radius of the concave portion is excessively small compared to the thickness of the hard layer as well, and the curvature of the concave portion is large. Thus, residual stress is likely to be concentrated at the concave portion, and there is a possibility that cracks are generated in the hard layer. On the other hand, when the ratio r2/D exceeds 3.0, the thickness of the hard layer is small at the concave portion. The wear of the hard layer coating the concave portion at a side surface of the drilling tip during drilling progresses early compared to the convex portion so that the tip main body made of a cemented carbide is likely to be exposed. Thus, there is a possibility that the life of the drill bit is shortened.

Further, when the angle θ(°) formed by the straight line that connects the point the convex portion tangents to the concave portion and the center of the convex arc of the convex portion to each other with respect to the tip center line in the cross section is less than 20(°), the thickness of the hard layer, which is on the outer peripheral portion, is small compared to the distal end portion of the convex portion, and the wear of the hard layer during drilling of the outer peripheral portion of the convex portion progresses early compared to the distal end portion so that the tip main body is likely to be exposed. Thus, there is a possibility that the life of the drill bit is shortened. On the other hand, when the angle θ(°) formed by the straight line that connects the point the convex portion tangents to the concave portion and the center of the convex arc of the convex portion to each other with respect to the tip center line in the cross section exceeds 90(°), the radius r2 of the concave portion is small so that the curvature is large, and residual stress is likely to be concentrated in the vicinity of the tangent point to the convex portion, thereby creating a possibility of becoming a origin of fracture of the hard layer when an impact load acts.

In a case where the diameter D (mm) of the posterior end portion of the tip main body is within a range of 14 (mm) to 20 (mm) in particular, the ratio r1/D of the radius r1 (mm) of the convex arc of the convex portion in the cross section with respect to the diameter D (mm) of the posterior end portion of the tip main body may be within a range of 0.18 to 0.45.

A connecting portion having a convex arc shape of which a surface is convex in a cross section taken along the tip center line may be provided between the posterior end portion of the tip main body and the concave portion. Accordingly, residual stress generated by sintering can be more relaxed. In a case of providing such a connecting portion of which a cross section has a convex arc shape, it is desirable that a ratio r3/D of a radius r3 (mm) of a convex arc of the connecting portion in the cross section with respect to the diameter D (mm) of the posterior end portion of the tip main body is within a range of 0.05 to 0.2.

That is, when the ratio r3/D of the radius r3 (mm) of the convex arc in the cross section of the connecting portion with respect to the diameter D (mm) is less than 0.05, the radius of the connecting portion is excessively small, and the curvature is large. Thus, residual stress generated by sintering or stress caused by a drilling load is likely to be concentrated, and there is a possibility that an effect of preventing cracks in the hard layer is lost. On the other hand, when the ratio r3/D exceeds 0.2, the thickness of the hard layer is small on the posterior end side of the connecting portion. The progress of wear of the hard layer during drilling is fast so that the tip main body is likely to be exposed. Thus, there is a possibility that the life of the drill bit is shortened.

In the drilling tip, the hard layer may be configured to have a multi-layer structure including a plurality of diamond sintered body layers having diamond particle contents different from each other. In this configuration, a diamond particle content and a layer thickness can be adjusted in each diamond sintered body layer configuring the hard layer. With this adjustment, it is also possible to reduce residual stress generated by sintering while maintaining the hardness of the outermost surface layer of the hard layer. For example, in a case of a structure having at least two or more layers, it is desirable to have a configuration where a diamond particle content in an outermost surface layer is 65 vol % or more and 95 vol % or less and a diamond particle content in a layer between the outermost surface layer and a cemented carbide is less than 60 vol %. In a case of a three-layer structure, a configuration where a diamond particle content in a layer in contact with an outermost surface layer is less than 60 vol % and more than 35 vol %, a diamond particle content in a layer in contact with a cemented carbide is 50 vol % or less and 20 vol % or more, and a diamond particle content in each layer from the outermost surface layer to the cemented carbide decreases is preferable to reduce residual stress generated by sintering.

Advantageous Effects of Invention

As described above, in the drilling tip and the drill bit of the present invention, residual stress generated by sintering can be relaxed, the exposure of the tip main body caused by the wear of the hard layer during drilling can be prevented, and it is possible to perform efficient drilling by improving impact resistance and wear resistance and extending the life of the drilling tip and the life of the drill bit.

DETAILED DESCRIPTION OF THE INVENTION

Figure 1:
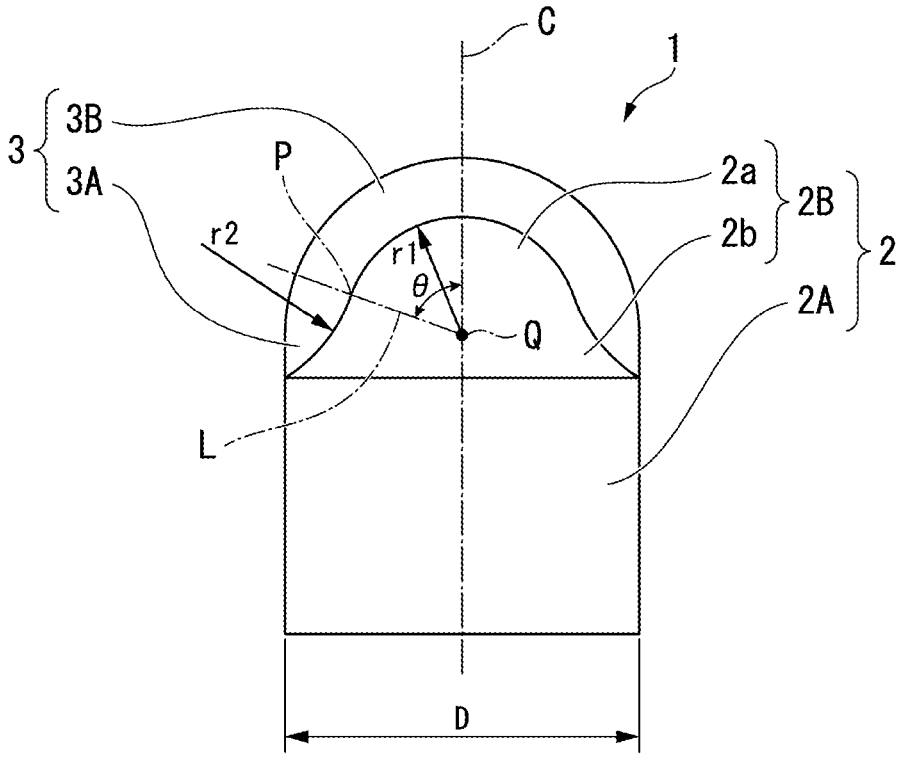
FIG. 1 is a cross-sectional view illustrating a first embodiment of a drilling tip of the present invention, taken along a tip center line.
Figure 2:
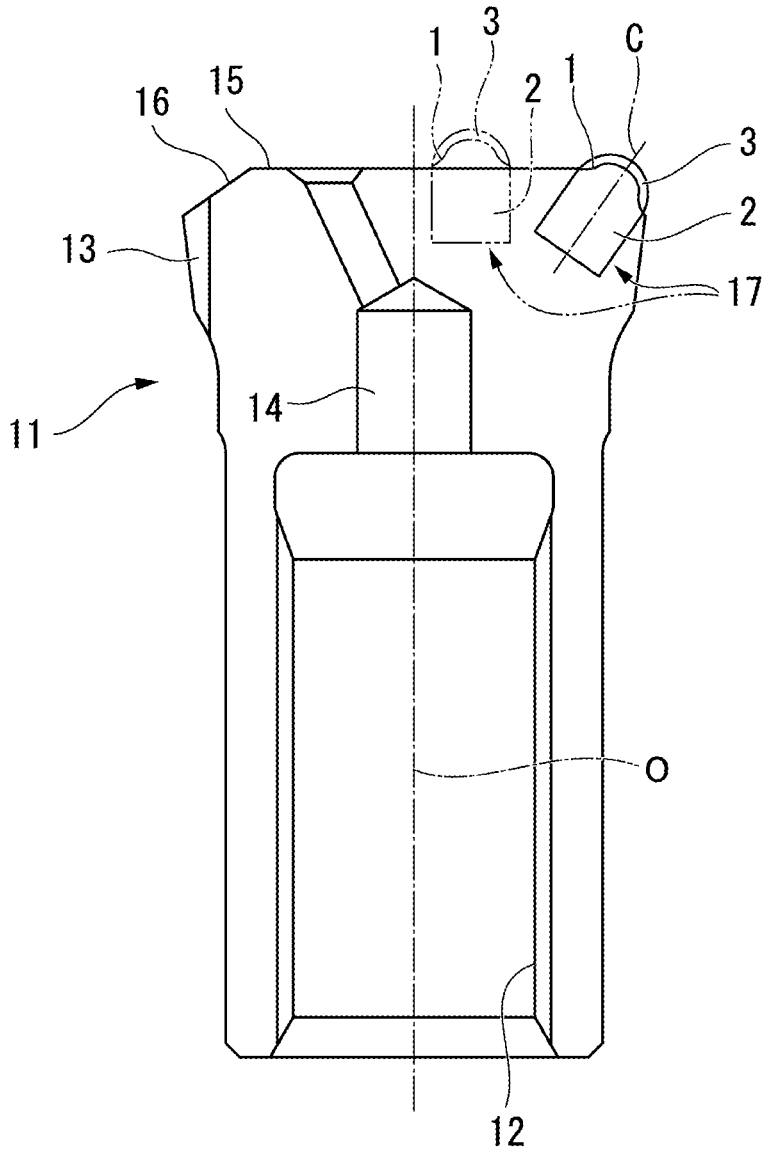
FIG. 2 is a cross-sectional view illustrating one embodiment of a drill bit of the present invention, in which the drilling tip of the embodiment illustrated in FIG. 1 is attached to a distal end portion of a bit main body, taken along an axial line of the bit main body.

FIG. 1 is a cross-sectional view illustrating a first embodiment of a drilling tip of the present invention (drilling tip of Example 1 in an example to be described later), and FIG. 2 is a cross-sectional view illustrating an embodiment of a drill bit of the present invention to which the drilling tip of the embodiment is attached. A drilling tip 1 of the present embodiment includes a tip main body 2 that is formed integrally with a columnar or disk-shaped posterior end portion 2A centered on a tip center line C and a distal end portion 2B, whose outer diameter from the tip center line C gradually decreases from the posterior end portion 2A toward a distal end side, and is made of a cemented carbide and a hard layer 3 that coats a surface of the distal end portion 2B of the tip main body 2 and is made of a polycrystalline diamond sintered body having hardness higher than the tip main body 2.

As illustrated in FIG. 1, the distal end portion 2B of the tip main body 2 has a convex portion 2*a* having a convex arc shape of which a surface is convex toward the distal end side in a cross section taken along the tip center line C and a concave portion 2*b* having a concave arc shape in the cross section also taken along the tip center line C, of which a surface tangents to the convex arc of the cross section of the convex portion 2*a* at a tangent point P and which extends to an outer peripheral side as going toward a posterior end side of the tip main body 2. In the present embodiment, the surface of the convex portion 2*a* is formed in a convex spherical shape having a center on the tip center line C, and the surface of the concave portion 2*b* in the cross section intersects an outer peripheral surface of the posterior end portion 2A of the tip main body 2 at an obtuse angle.

In addition, a diameter D (mm) of the posterior end portion 2A of the tip main body 2 is within a range of 8 (mm) to 20 (mm), and is 9 (mm) in the present embodiment. A ratio r1/D of a radius r1 (mm) of the convex arc of the convex portion 2*a* in the cross section taken along the tip center line C with respect to the diameter D (mm) of the posterior end portion 2A of the tip main body 2 is within a range of 0.1 to 0.65, and a ratio r2/D of a radius r2 (mm) of the concave arc of the concave portion 2*b* in the cross section with respect to the diameter D is within a range of 0.05 to 3.0.

Herein, in the present embodiment in which the diameter D (mm) of the posterior end portion 2A of the tip main body 2 is 9 (mm), the radius r1 (mm) of the convex portion 2*a* is 3 (mm), and the ratio r1/D is 0.33. In addition, the radius r2 (mm) of the concave portion 2*b* is 4 (mm), and the ratio r2/D is 0.44. The cross section taken along the tip center line C described above may be a cross section taken along the tip center line C in a range where a distance from the tip center line C is within 0.1 (mm).

Further, an angle θ(°) formed by a straight line L that connects the tangent point P which the convex portion 2*a* tangents to the concave portion 2*b* and a center Q of the convex arc of the convex portion 2*a* to each other with the tip center line C in the cross section also taken along the tip center line C is within the range of 20(°) to 90(°). In the present embodiment, the angle θ(°) is 70(°).

The hard layer 3 is a single layer in the present embodiment. A posterior end portion 3A of the hard layer 3, which is connected to the distal end side of the posterior end portion 2A of the tip main body 2, has an outer peripheral surface that has a cylindrical surface shape centered on the tip center line C having the diameter D (mm) equal to the posterior end portion 2A of the tip main body 2. A surface of a distal end portion 3B of the hard layer 3 has a convex hemispherical surface shape, which is smoothly connected to the outer peripheral surface of the posterior end portion 3A and is centered on the center Q. That is, the drilling tip 1 of the present embodiment is a so-called button tip. In addition, the thickness of the hard layer 3 is made substantially uniform at least on the distal end side of the tangent point P.

The drill bit having a distal end portion to which such a drilling tip 1 is attached has a bit main body 11 that is formed of a steel material and is formed in a substantially bottomed cylindrical shape centered on an axial line O as illustrated in FIG. 2. A bottomed portion is the distal end portion (upper portion in FIG. 2), and the drilling tip 1 is attached to the distal end portion. In addition, a female screw portion 12 is formed in an inner periphery of a cylindrical posterior end portion (lower portion in FIG. 2). As a drill rod connected to a drill device is screwed into the female screw portion 12 and a striking force and an impelling force toward a distal end side in an axial line O direction and a rotating force about the axial line O are transmitted, the drilling tip 1 crushes a bedrock to form a borehole.

The distal end portion of the bit main body 11 has an outer diameter slightly larger than the posterior end portion, a plurality of discharge flutes 13 extending parallel to the axial line O are formed at a distance from each other in a circumferential direction in an outer periphery of the distal end portion, and crushed debris generated by the drilling tip 1 crushing the bedrock is discharged to the posterior end side through the discharge flutes 13. In addition, a blow hole 14 is formed along the axial line O from a bottom surface of the female screw portion 12 of the bottomed bit main body 11, the blow hole 14 obliquely branches at the distal end portion of the bit main body 11 so that an opening is formed in a distal end surface of the bit main body 11, and a fluid such as compressed air supplied via the drill rod is ejected to facilitate the discharge of crushed debris.

Further, the distal end surface of the bit main body 11 includes a circular face surface 15 that is on an inner peripheral side perpendicular to the axial line O and is centered on the axial line O and a gauge surface 16 that is positioned on an outer periphery of the face surface 15 and has a conical base surface shape toward the posterior end side as going toward the outer peripheral side. The blow hole 14 is opened in the face surface 15, and a distal end of the discharge flute 13 is opened on the outer peripheral side of the gauge surface 16. In addition, a plurality of fitting holes 17 each having a circular cross section are formed in the face surface 15 and the gauge surface 16 to be perpendicular to the face surface 15 and the gauge surface 16 such that each of opening portions of the blow hole 14 and the discharge flutes 13 is avoided.

The drilling tip is fixed, that is, buried and attached to such fitting holes 17 by being tightly fitted through press-fitting and shrink-fitting or being brazed in a state where the posterior end portion 2A of the tip main body 2 is buried as illustrated in FIG. 2. Further, the distal end portion of the drilling tip 1 coated with the hard layer 3 protrudes from the face surface 15 and the gauge surface 16 to crush the bedrock by the striking force, the impelling force, and the rotating force, which are described above.

In the drilling tip 1 that is attached to the bit main body 11 of the drill bit in this manner and has the configuration, the distal end portion 2B of the tip main body 2 has the convex portion 2*a* having the convex arc shape of which the surface is convex toward the distal end side in the cross section taken along the tip center line C and the concave portion 2*b* having the concave arc shape in the cross section also taken along the tip center line C, of which the surface tangents to the convex arc in the cross section of the convex portion 2*a* and which extends to the outer peripheral side toward the posterior end side of the tip main body 2. That is, since corner parts intersecting at an angle are not formed at an interface between the tip main body 2 and the hard layer 3 unlike the drilling tip described in Patent Document 3, residual stress generated by sintering can be relaxed, and cracks are not generated in the hard layer 3 with such corner parts as a origin thereof.

Herein, if the diameter D (mm) of the posterior end portion 2A of the tip main body 2 is smaller than 8 (mm), the residual stress of the interface between the hard layer 3 and the tip main body 2 can be relaxed, but an impact load acting on the tip main body 2 per unit area increases in a case of being used in drilling under a higher impact load condition. Therefore, damage caused by the origin in the tip main body 2 is likely to occur, and there is a possibility that the life of the drill bit is shortened. On the other hand, when the diameter D (mm) of the posterior end portion 2A of the tip main body 2 is larger than 20 (mm), the volume of the hard layer 3 is large with respect to the area of the tip main body 2 in contact with the hard layer 3, residual stress that occurs at the interface between the hard layer 3 and the tip main body 2 cannot be relaxed, and thus there is a possibility that cracks are generated after sintering.

In the drilling tip 1 having the configuration, with respect to the diameter D (mm) of the posterior end portion 2A of the tip main body 2, which is within a range of 8 (mm) to 20 (mm), the ratio r1/D of the radius r1 (mm) of the convex arc of the convex portion 2*a* in the cross section is within a range of 0.1 to 0.65, and the ratio r2/D of the radius r2 (mm) of the concave arc of the concave portion 2*b* in the cross section is within a range of 0.05 to 3.0. The angle θ(°) formed by the straight line L that connects the tangent point P which the convex portion 2*a* tangents to the concave portion 2*b* and the center Q of the convex arc of the convex portion 2*a* to each other with the tip center line C in the cross section taken along the tip center line C is within a range of 20(°) to 90(°). For this reason, residual stress at the interface between the hard layer 3 and the tip main body 2 can be more reliably relaxed, and it is possible to extend the life by securing a sufficient thickness for the hard layer 3.

When the ratio r1/D is less than 0.1, the radius r1 of the convex portion 2*a* is excessively small compared to the thickness of the hard layer 3, and the curvature of the convex portion 2*a* is large. Thus, residual stress is likely to be concentrated at a distal end portion of the convex portion 2*a*, and there is a possibility that cracks are likely to be generated in the hard layer 3. On the other hand, conversely, when the ratio r1/D exceeds 0.65, the thickness of the hard layer 3 is small at an outer peripheral portion of the convex portion 2*a*. The wear of the hard layer 3 at the outer peripheral portion of the convex portion 2*a* during drilling progresses early compared to the distal end portion so that the convex portion 2*a* of the tip main body 2 made of a cemented carbide is likely to be exposed. Thus, there is a possibility that the life of the drill bit is shortened.

In addition, when the ratio r2/D is less than 0.05, the radius r2 of the concave portion 2*b* is excessively small compared to the thickness of the hard layer 3 as well, and the curvature of the concave portion 2*b* is large. Thus, residual stress is likely to be concentrated at the concave portion 2*b*, and there is a possibility that cracks are generated in the hard layer 3. On the other hand, when the ratio r2/D exceeds 3.0, the thickness of the hard layer 3 is small at the concave portion 2*b*. The wear of the hard layer 3 coating the concave portion 2*b* at a side surface of the drilling tip 1 during drilling progresses early compared to the convex portion 2*a* so that the tip main body 2 made of a cemented carbide is likely to be exposed. Thus, there is a possibility that the life of the drill bit is shortened.

Further, when the angle θ(°) formed by the straight line L that connects the tangent point P which the convex portion 2*a* tangents to the concave portion 2*b* and the center Q of the convex arc of the convex portion 2*a* to each other with the tip center line C in the cross section is less than 20(°), the thickness of the hard layer 3 which is on the outer peripheral portion is small compared to the distal end portion of the convex portion 2*a*, and the wear of the hard layer 3 during drilling of the outer peripheral portion of the convex portion 2*a* progresses early compared to the distal end portion so that the tip main body 2 is likely to be exposed. Thus, there is a possibility that the life of the drill bit is shortened. On the other hand, when the angle θ(°) formed by the straight line L with respect to the tip center line C in the cross section exceeds 90(°), the radius r2 of the concave portion 2*b* is small so that the curvature is large, and residual stress is likely to be concentrated in the vicinity of the tangent point P with the convex portion 2*a*, thereby creating a possibility of becoming a fracture origin of the hard layer 3 when an impact load acts.

Figure 3:
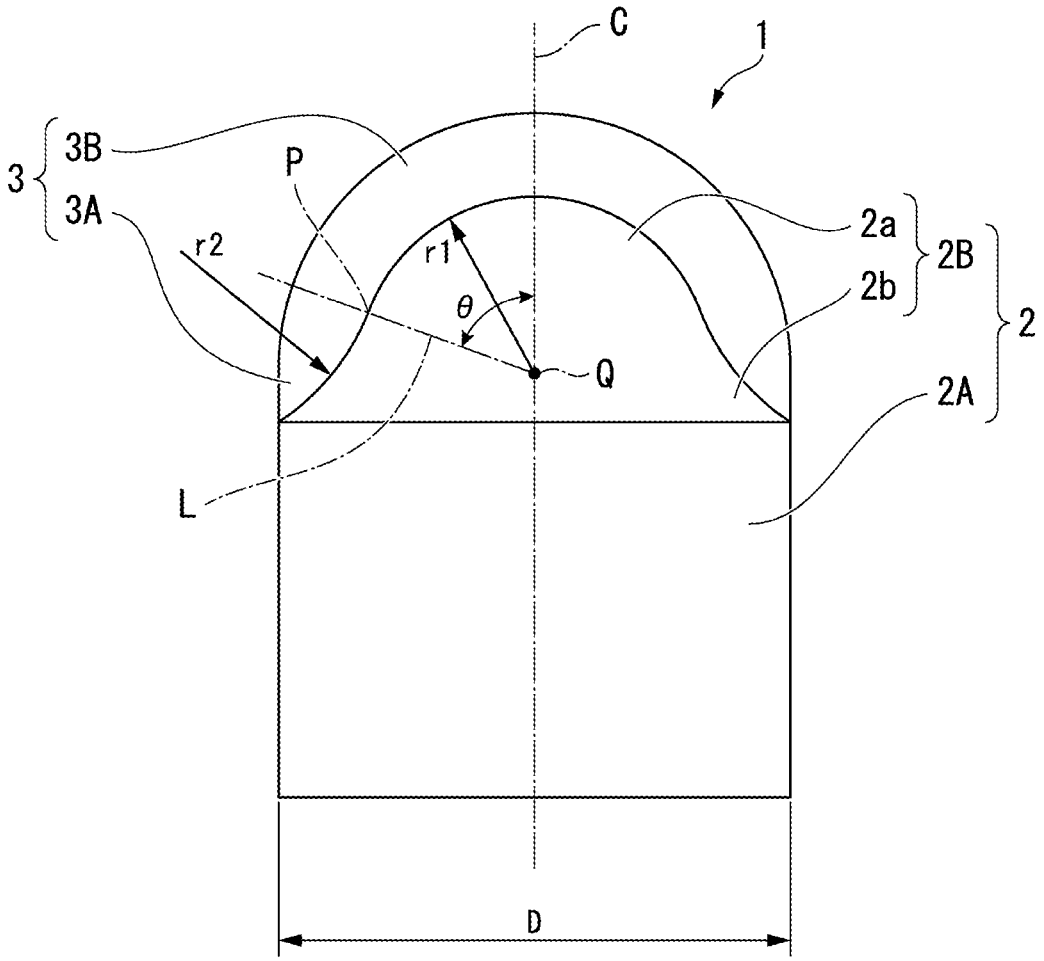
FIG. 3 is a cross-sectional view illustrating a second embodiment of the drilling tip of the present invention, taken along the tip center line.

Next, FIG. 3 is a cross-sectional view illustrating a second embodiment of the drilling tip 1 of the present invention (drilling tip of Example 2 in the example to be described later). Starting with the second embodiment illustrated in FIG. 3, even in third to fifth embodiments of the drilling tip 1 of the present invention illustrated in FIGS. 4 to 6, portions common to the drilling tip 1 of the first embodiment illustrated in FIG. 1 will be assigned with the same reference signs as in FIG. 1, and a description thereof will be omitted. In the drilling tip 1 of the second embodiment, the diameter D (mm) of the posterior end portion 2A of the tip main body 2 is 13 (mm), the radius r1 of the convex portion 2*a* of the distal end portion 2B of the tip main body 2 is 4.5 (mm), the ratio r1/D is 0.35, the radius r2 (mm) of the concave portion 2*b* is 6 (mm), the ratio r2/D is 0.46, and the angle θ(°) formed by the straight line L with respect to the tip center line C is 70(°).

Figure 4:
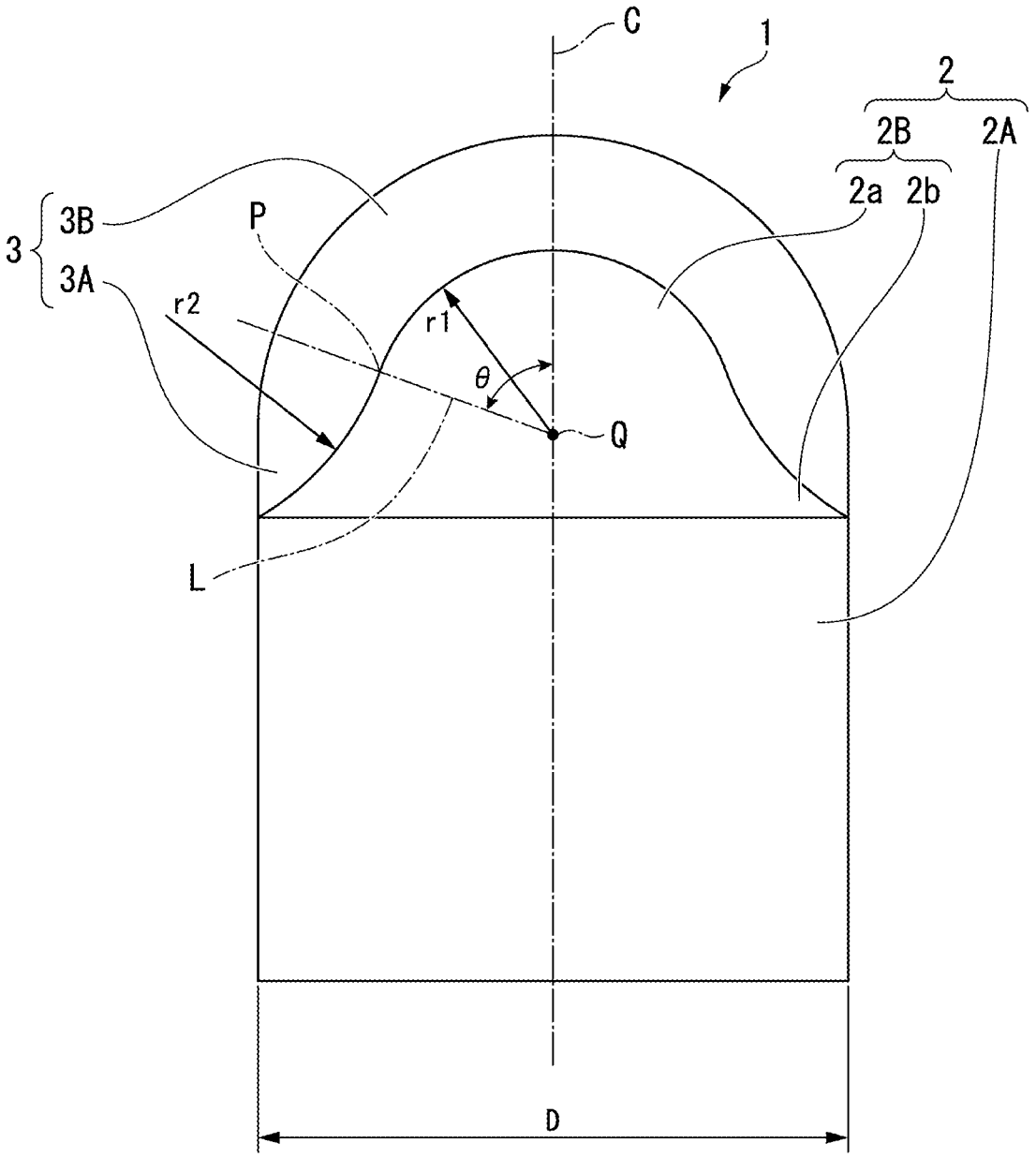
FIG. 4 is a cross-sectional view illustrating a third embodiment of the drilling tip of the present invention, taken along the tip center line.

In addition, in the drilling tip (drilling tip of Example 10 in the example to be described later) 1 of the third embodiment illustrated in FIG. 4, the diameter D (mm) of the posterior end portion 2A of the tip main body 2 is 16 (mm), the radius r1 of the convex portion 2*a* of the distal end portion 2B of the tip main body 2 is 5 (mm), the ratio r1/D is 0.31, the radius r2 (mm) of the concave portion 2*b* is 7.5 (mm), the ratio r2/D is 0.47, and the angle θ(°) formed by the straight line L with respect to the tip center line C is 70(°).

Figure 5:
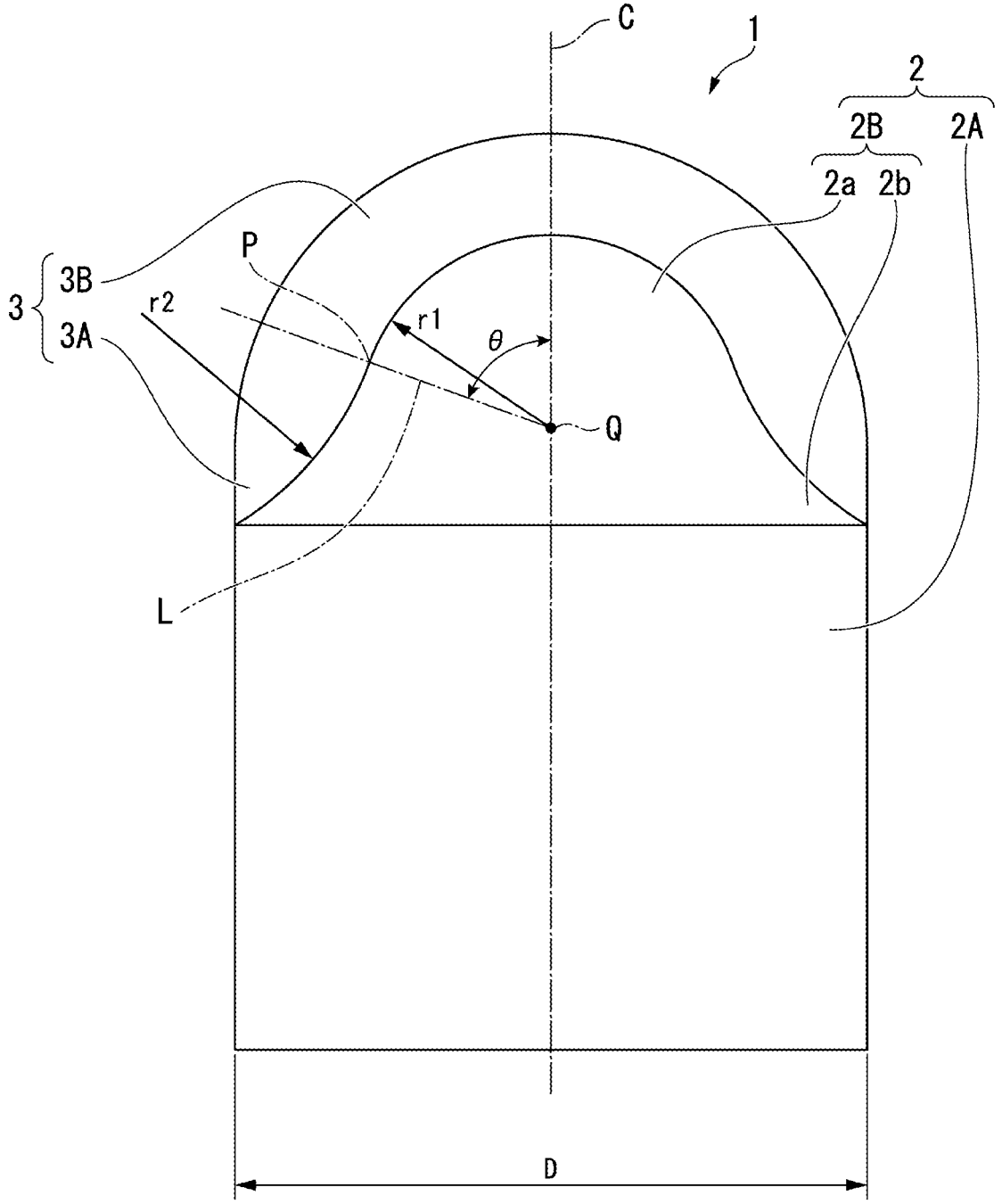
FIG. 5 is a cross-sectional view illustrating a fourth embodiment of the drilling tip of the present invention, taken along the tip center line.

Further, in the drilling tip (drilling tip of Example 11 in the example to be described later) 1 of the fourth embodiment illustrated in FIG. 5, the diameter D (mm) of the posterior end portion 2A of the tip main body 2 is 18 (mm), the radius r1 of the convex portion 2*a* of the distal end portion 2B of the tip main body 2 is 5.5 (mm), the ratio r1/D is 0.3, the radius r2 (mm) of the concave portion 2*b* is 9 (mm), the ratio r2/D is 0.5, and the angle θ(°) formed by the straight line L with respect to the tip center line C is 70(°).

In a case where the diameter D (mm) of the posterior end portion 2A of the tip main body 2 is within a range of 14 (mm) to 20 (mm) as in the third and fourth embodiments, the ratio r1/D of the radius r1 (mm) of the convex arc of the convex portion 2*a* in the cross section taken along the tip center line C with respect to the diameter D (mm) of the posterior end portion 2A of the tip main body 2 may be within a range of 0.18 to 0.45 as described above. Accordingly, also in the drilling tip 1 in which the diameter D (mm) of the posterior end portion 2A of the tip main body 2 is relatively large, the exposure of the tip main body 2 caused by wear can be suppressed while more reliably relaxing residual stress.

Figure 6:
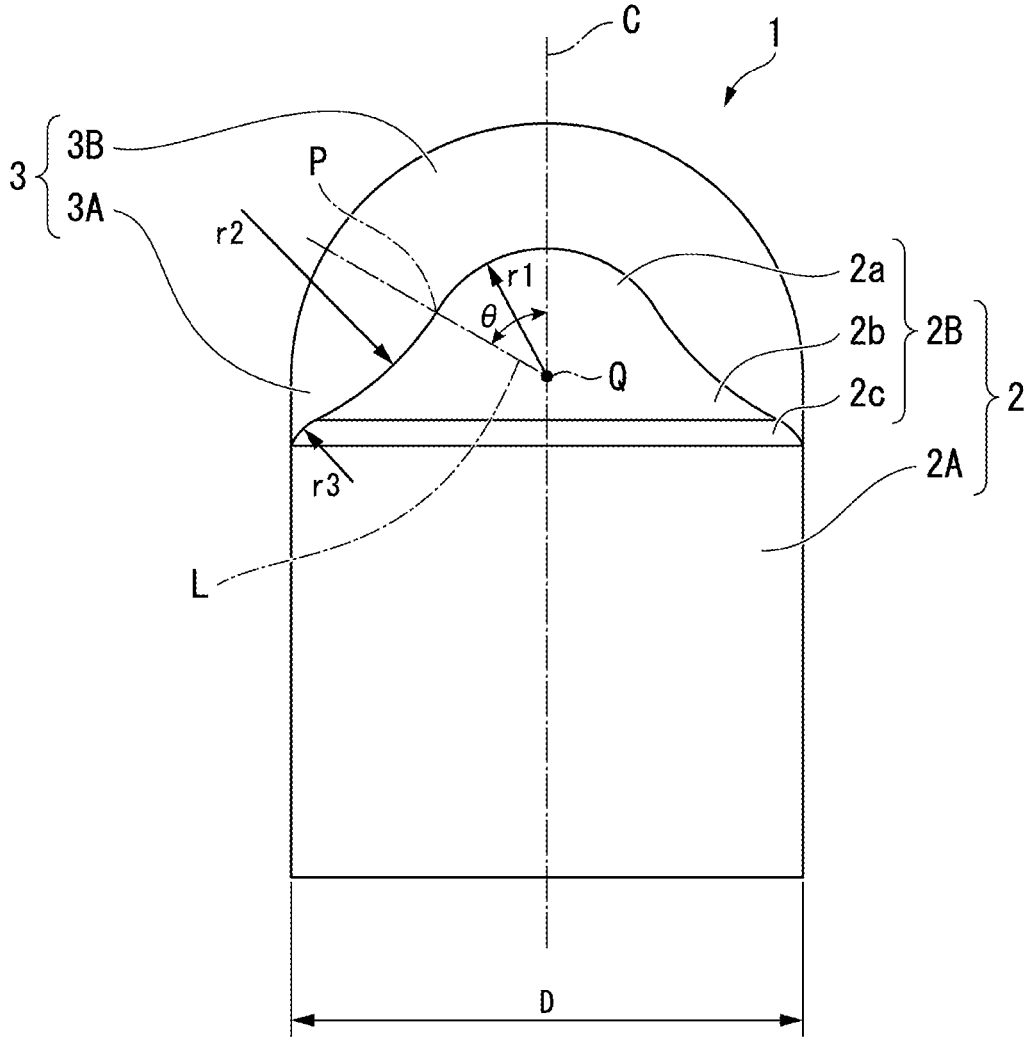
FIG. 6 is a cross-sectional view illustrating a fifth embodiment of the drilling tip of the present invention, taken along the tip center line.

In addition, the drilling tip (drilling tip of Example 6 in the example to be described later) 1 of the fifth embodiment illustrated in FIG. 6 has, between the posterior end portion 2A of the tip main body 2 and the concave portion 2*b* of the distal end portion 2B, a connecting portion 2*c* having a convex arc shape of which a surface is convex in the cross section taken along the tip center line C. Herein, the diameter D (mm) of the posterior end portion 2A of the tip main body 2 of the fifth embodiment is 13 (mm) as in the second embodiment, the radius r1 of the convex portion 2*a* of the distal end portion 2B of the tip main body 2 is 3.25 (mm), the ratio r1/D is 0.25, the radius r2 (mm) of the concave portion 2*b* is 7.8 (mm), the ratio r2/D is 0.6, and the angle θ(°) formed by the straight line L with respect to the tip center line C is 60(°).

Further, in the fifth embodiment, a ratio r3/D of a radius r3 (mm) of the convex arc of the connecting portion 2*c* in the cross section taken along the tip center line C with respect to the diameter D (mm) of the posterior end portion 2A of the tip main body 2 is within a range of 0.05 to 0.2. In the present embodiment, the radius r3 (mm) is 1.3 (mm), and accordingly the ratio r3/D of the radius r3 with respect to the diameter D (mm) is 0.1.

In such a drilling tip 1 of the fifth embodiment, the residual stress of the interface between the tip main body 2 and the hard layer 3 at the connecting portion 2*c* can be more relaxed. When the ratio r3/D of the radius r3 (mm) of the convex arc in the cross section of the connecting portion 2*c* with respect to the diameter D (mm) of the posterior end portion 2A of the tip main body 2 is less than 0.05, the radius r3 of the connecting portion 2*c* is excessively small, and there is a possibility that an effect of relaxing the residual stress generated by sintering is lost. When the ratio r3/D exceeds 0.2, the thickness of the hard layer 3 on the posterior end side of the connecting portion 2*c* is small so that the tip main body 2 is likely to be exposed. Thus, it is desirable for the ratio r3/D to be within a range of 0.05 to 0.2 as described above.

Examples

Next, an effect of the present invention will be demonstrated by giving examples of the drilling tip of the present invention. In the present example, based on the embodiment, each of a plurality of fifteen types of the drilling tips 1, in which the diameter D (mm) of the posterior end portion 2A of the tip main body 2 is within a range of 8 (mm) to 20 (mm), the ratio r1/D of the radius r1 (mm) of the convex arc of the convex portion 2*a* in the cross section taken along the tip center line C with respect to the diameter D (mm) of the posterior end portion 2A of the tip main body 2 is within a range of 0.1 to 0.65, the ratio r2/D of the radius r2 (mm) of the concave arc of the concave portion 2*b* in the cross section with respect to the diameter D (mm) is within a range of 0.05 to 3.0, the angle θ(°) formed by the straight line L with respect to the tip center line in the cross section is within a range of 20(°) to 90(°), was manufactured one by one.

In any drilling tip 1, a hard layer having the Vickers hardness of 4,000 HV or more and a thickness along the tip center line C of 1.1 mm or more and 3.0 mm or less was formed at the distal end portion of the tip main body 2 made of a cemented carbide.

Among these, four types of the drilling tips 1 each had, between the posterior end portion 2A of the tip main body 2 and the concave portion 2*b* of the distal end portion 2B, the connecting portion 2*c* having a convex arc shape of which a surface is convex in the cross section taken along the tip center line C as in the fifth embodiment. The ratio r3/D of the radius r3 (mm) of the convex arc of the connecting portion 2*c* in the cross section with respect to the diameter D (mm) of the posterior end portion of the tip main body was within a range of 0.05 to 0.2.

In addition, one type of the drilling tip 1 (Example 14) had a three-layer structure hard layer in which diamond particle contents are different from each other. Among the three hard layers, an outermost hard layer was a hard layer having the Vickers hardness of 4,000 HV or more and a thickness along the tip center line C of 1.2 mm. The two layers between the outermost hard layer and cemented carbide were layers having the Vickers hardness of 2,800 HV or less and a total thickness along the tip center line C of 1.2 mm.

As Examples 1 to 15, these are shown in Table 1 together with the diameter D (mm), the ratio r1/D, the angle θ(°), the ratio r2/D, and the ratio r3/D, if the connecting portion 2*c* is included.

In addition, each of a plurality of eight types of the drilling tips 1, in which the diameter D (mm) of the posterior end portion 2A of the tip main body 2 is within a range of 8 (mm) to 20 (mm) but any one of the ratio r1/D, the ratio r2/D, and the angle θ(°) is out of the range of the embodiment, was manufactured one by one as a comparative example with respect to Examples 1 to 15. Among these, three types of the drilling tips 1 each had, between the posterior end portion 2A of the tip main body 2 and the concave portion 2*b* of the distal end portion 2B, the connecting portion 2*c* that has a convex arc shape of which a surface is convex in the cross section taken along the tip center line C. As Comparative Examples 1 to 8, these are shown in Table 2 together with the diameter D (mm), the ratio r1/D, the angle θ(°), the ratio r2/D, and the ratio r3/D, if the connecting portion 2*c* is included.

The radius r1 (mm) of the convex portion 2*a*, the radius r2 (mm) of the concave portion 2*b*, and the angle θ(°) of the drilling tip 1 of each of Examples 1 to 15 and Comparative Examples 1 to 8 were measured by cutting the drilling tip 1 along the tip center line C within a radius of 0.1 (mm) from the tip center line C with an electrical discharge machine and determining the position of the interface through image analysis based on a difference in color between a cemented carbide and a polycrystalline diamond sintered body. In addition, the center Q of the convex arc of the convex portion 2*a* was positioned on a line, which passes through the apex of the convex portion 2*a* in the distal end portion 2B of the tip main body 2 in a case where the cross section went through image analysis in such a manner and bisects the posterior end portion 2A in a radial direction.

Next, the impact resistance performance of each of the plurality of drilling tips 1 of Examples 1 to 15 and Comparative Examples 1 to 8 manufactured in such a manner was measured using a drop weight type impact tester. In the drop weight type impact test, the drilling tip 1 was fixed in a state where the distal end portion 2B of the tip main body 2 was faced upward, and impact was added by dropping a weight made of a cemented carbide along the tip center line C from immediately above the drilling tip 1. Impact energy (J) given to the drilling tip 1 was controlled by making the mass of the weight constant and changing the dropping height.

In addition, after adding impact by dropping the weight, the surface of the hard layer 3 of the drilling tip 1 was observed with a stereomicroscope. In a case where damage to the hard layer 3 was found, energy to which the impact was added was set as energy (J) that had led to the damage. Energy generated by dropping the weight was set to 10 (J) at the start of the test, and in a case where no damage was found in the hard layer 3, the tested ones, among the plurality of drilling tips 1, were replaced with untested ones. Then, a test of adding energy increased by 10 (J) was repeated until damage was found, and the energy (J) that had led to the damage was measured. The results are shown for Examples 1 to 15 and Comparative Examples 1 to 8 in Tables 1 and 2.

TABLE 1

| Example | D (mm) | r1/D | θ (°) | r2/D | r3/D | Energy led to destruction [J] |
|---|---|---|---|---|---|---|
| 1 | 9 | 0.33 | 70 | 0.44 | — | 140 |
| 2 | 13 | 0.35 | 70 | 0.46 | — | 160 |
| 3 | 13 | 0.10 | 20 | 1.50 | — | 80 |
| 4 | 13 | 0.30 | 40 | 0.30 | — | 110 |
| 5 | 13 | 0.65 | 35 | 1.50 | — | 70 |
| 6 | 13 | 0.25 | 60 | 0.60 | 0.10 | 150 |
| 7 | 13 | 0.55 | 55 | 0.05 | — | 110 |
| 8 | 13 | 0.33 | 90 | 0.50 | 0.20 | 140 |
| 9 | 13 | 0.35 | 70 | 3.00 | 0.10 | 130 |
| 10 | 16 | 0.31 | 70 | 0.47 | — | 150 |
| 11 | 18 | 0.30 | 70 | 0.50 | — | 150 |
| 12 | 18 | 0.18 | 70 | 0.90 | 0.05 | 130 |
| 13 | 18 | 0.45 | 60 | 0.60 | — | 120 |
| 14 | 18 | 0.30 | 70 | 0.46 | — | 120 |
| 15 | 20 | 0.30 | 70 | 0.48 | — | 100 |

TABLE 2

| Comparative Example | D (mm) | r1/D | θ (°) | r2/D | r3/D | Energy led to destruction [J] |
|---|---|---|---|---|---|---|
| 1 | 9 | 1.10 | 20 | 1.00 | — | 30 |
| 2 | 13 | 0.40 | 100 | 0.45 | — | 40 |
| 3 | 13 | 0.03 | 40 | 0.80 | 0.20 | 30 |
| 4 | 13 | 0.40 | 60 | 4.00 | — | 30 |
| 5 | 13 | 0.33 | 85 | 0.02 | 0.10 | 40 |
| 6 | 18 | 0.40 | 5 | 1.40 | 0.10 | 30 |
| 7 | 16 | 1.30 | 20 | 0.46 | — | 30 |
| 8 | 18 | 0.05 | 30 | 0.75 | — | 30 |

From the results of Tables 1 and 2, first, in the drilling tip 1 of each of Comparative Examples 1 to 8, in which any one of the diameter D (mm), the ratio r1/D, the angle θ(°), and the ratio r2/D is out of the range of the embodiment, it has turned out that energy (J) that has led to the destruction is 40 (J) or less, and the impact resistance is poor.

On the other hand, in the drilling tip 1 of each of Examples 1 to 15 in which all of the diameter D (mm), the ratio r1/D, the angle θ(°), and the ratio r2/D are within the respective ranges of the embodiment, even in Example 5 in which energy (J) that has led to destruction is smallest, 70 (J) could be obtained which is approximately two times the impact resistance of Comparative Examples 1 to 8, and in Example 2 in which energy (J) that has led to destruction is largest, 160 (J) could be obtained which is approximately four or more times the impact resistance of Comparative Examples 1 to 8.

INDUSTRIAL APPLICABILITY

As described above, in the drilling tip and the drill bit of the present invention, residual stress during sintering can be relaxed, the exposure of the tip main body caused by the wear of the hard layer during drilling can be prevented, and it is possible to perform efficient drilling by improving impact resistance and wear resistance and extending the life of the drilling tip and the life of the drill bit.

REFERENCE SIGNS LIST

1 Drilling Tip
2 Tip main body
2*a* Posterior end portion of tip main body 2
2*b* Distal end portion of tip main body 2
2*a* Convex portion
2*b* Concave portion
2*c* Connecting portion
3 Hard layer
11 Bit main body
C Tip center line
O Axial line of bit main body 11
D Diameter of posterior end portion 2A of tip main body 2
r1 Radius of convex arc of convex portion 2*a* in cross section taken along tip center line C
r2 Radius of concave arc of concave portion 2*b* in cross section taken along tip center line C
r3 Radius of convex arc of connecting portion 2*c* in cross section taken along tip center line C
P Point which convex portion 2*a* tangents to concave portion 2*b* in cross section taken along tip center line C
Q Center of convex arc of convex portion 2*a* in cross section taken along tip center line C
L Straight line that connects tangent point P and center Q to each other
θ Angle formed by straight line L with respect to tip center line C in cross section taken along tip center line C

What is claimed is:

1. A drilling tip that is attached to a distal end portion of a drill bit to perform drilling, the drilling tip comprising:

a tip main body that has a posterior end portion having a columnar or disk shape centered on a tip center line and a distal end portion having an outer diameter from the tip center line, which gradually decreases from the posterior end portion toward a distal end side, and is made of a cemented carbide; and a hard layer that coats the distal end portion of the tip main body and is made of a polycrystalline diamond sintered body, wherein the distal end portion of the tip main body has a convex portion having a convex arc shape of which a surface is convex toward the distal end side in a cross section taken along the tip center line, and a concave portion having a concave arc shape in a cross section taken along the tip center line, of which a surface tangents to a convex arc in the cross section of the convex portion and which extends to an outer peripheral side as going toward a posterior end side of the tip main body, a diameter D (mm) of the posterior end portion of the tip main body is within a range of 8 (mm) to 20 (mm), with respect to the diameter D (mm) of the posterior end portion of the tip main body, a ratio r1/D of a radius r1 (mm) of the convex arc of the convex portion in the cross section is within a range of 0.1 to 0.65, and a ratio r2/D of a radius r2 (mm) of a concave arc of the concave portion in the cross section is within a range of 0.05 to 3.0, and an angle θ(°) formed by a straight line that connects a point which the convex portion tangents to the concave portion and a center of the convex arc of the convex portion to each other with respect to the tip center line in the cross section is within a range of 20(°) to 90(°).

2. The drilling tip according to claim 1, wherein the diameter D (mm) of the posterior end portion of the tip main body is 14 (mm) to 20 (mm), and the ratio r1/D of the radius r1 (mm) of the convex arc of the convex portion in the cross section with respect to the diameter D (mm) of the posterior end portion of the tip main body is within a range of 0.18 to 0.45.

3. The drilling tip according to claim 1, wherein a connecting portion having a convex arc shape of which a surface is convex in a cross section taken along the tip center line is provided between the posterior end portion of the tip main body and the concave portion, and a ratio r3/D of a radius r3 (mm) of a convex arc of the connecting portion in the cross section with respect to the diameter D (mm) of the posterior end portion of the tip main body is within a range of 0.05 to 0.2.

4. The drilling tip according to claim 1, wherein an outermost surface layer of the hard layer has Vickers hardness of 4,000 HV or more, and the hard layer has a thickness of 1.1 mm or more and 3.0 mm or less.

5. The drilling tip according to claim 1, wherein the hard layer has a multi-layer structure including a plurality of diamond sintered body layers having diamond particle contents different from each other.

6. A drill bit comprising the drilling tip according to claim 1 that is attached to a distal end portion of a bit main body, wherein a fitting hole is formed in the distal end portion of the bit main body, and the drilling tip is attached such that the posterior end portion of the tip main body is buried in the fitting hole.

* * * * *